US012007150B2

(12) United States Patent
Iwata et al.

(10) Patent No.: US 12,007,150 B2
(45) Date of Patent: Jun. 11, 2024

(54) REFRIGERATION CYCLE DEVICE

(71) Applicant: DAIKIN INDUSTRIES, LTD., Osaka (JP)

(72) Inventors: Ikuhiro Iwata, Osaka (JP); Eiji Kumakura, Osaka (JP); Kazuhiro Furusho, Osaka (JP); Ryusuke Fujiyoshi, Osaka (JP); Hiromune Matsuoka, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 510 days.

(21) Appl. No.: 17/219,395

(22) Filed: Mar. 31, 2021

(65) Prior Publication Data

US 2021/0215398 A1 Jul. 15, 2021

Related U.S. Application Data

(63) Continuation of application No. PCT/JP2019/038400, filed on Sep. 27, 2019.

(30) Foreign Application Priority Data

Oct. 2, 2018 (JP) ..... 2018-187369

(51) Int. Cl.
*F25B 41/30* (2021.01)
*F25B 1/10* (2006.01)
(Continued)

(52) U.S. Cl.
CPC ..... *F25B 49/02* (2013.01); *F25B 1/10* (2013.01); *F25B 7/00* (2013.01); *F25B 9/008* (2013.01);
(Continued)

(58) Field of Classification Search
CPC .... F25B 1/10; F25B 7/00; F25B 9/008; F25B 43/00; F25B 49/02; F25B 2400/23; F25B 2600/2513; F25B 2700/1931
See application file for complete search history.

(56) References Cited

U.S. PATENT DOCUMENTS

2007/0144201 A1* 6/2007 Matsumoto ..... B60H 1/323 62/239
2007/0251256 A1* 11/2007 Pham ..... F25B 43/006 62/324.1
(Continued)

FOREIGN PATENT DOCUMENTS

JP 2003-74999 A 3/2003
JP 2008-2759 A 1/2008
(Continued)

OTHER PUBLICATIONS

International Preliminary Report on Patentability and English translation of the Written Opinion of the International Searching Authority for International Application No. PCT/JP2019/038400, dated Apr. 15, 2021.
(Continued)

*Primary Examiner* — Jonathan Bradford
(74) *Attorney, Agent, or Firm* — Birch, Stewart, Kolasch & Birch, LLP

(57) ABSTRACT

Even if, in decompressing a refrigerant by an expansion mechanism, the temperature of the refrigerant cannot be sufficiently reduced, in order to increase the evaporation capacity of a use-side heat exchanger, a main expansion mechanism including an expansion element of a rotary or scroll type that causes power to be produced by decompressing a main refrigerant is provided at a main refrigerant circuit in which the main refrigerant circulates. Further, a sub-refrigerant circuit that differs from the main refrigerant circuit and in which a sub-refrigerant circulates is provided.
(Continued)

A sub-use-side heat exchanger that is provided at the sub-refrigerant circuit and that functions as an evaporator of the sub-refrigerant is caused to function as a heat exchanger that cools the main refrigerant that flows between the main expansion mechanism and a main use-side heat exchanger.

19 Claims, 8 Drawing Sheets

(51) Int. Cl.

| | |
|---|---|
| ***F25B 7/00*** | (2006.01) |
| ***F25B 9/00*** | (2006.01) |
| ***F25B 40/00*** | (2006.01) |
| ***F25B 41/39*** | (2021.01) |
| ***F25B 43/00*** | (2006.01) |
| ***F25B 49/02*** | (2006.01) |

(52) U.S. Cl.
CPC ..... *F25B 40/00* (2013.01); *F25B 41/39* (2021.01); *F25B 43/00* (2013.01); *F25B 2313/0314* (2013.01); *F25B 2313/0315* (2013.01); *F25B 2400/23* (2013.01); *F25B 2600/2513* (2013.01); *F25B 2700/1931* (2013.01); *F25B 2700/1933* (2013.01); *F25B 2700/21151* (2013.01); *F25B 2700/21152* (2013.01)

(56) References Cited

U.S. PATENT DOCUMENTS

| | | | |
|---|---|---|---|
| 2010/0083677 | A1 | 4/2010 | Lifson et al. |
| 2017/0074569 | A1* | 3/2017 | Kurata ..... F25B 49/027 |

FOREIGN PATENT DOCUMENTS

| | | | |
|---|---|---|---|
| JP | 2012-207835 | A | 10/2012 |
| JP | 2013-139938 | A | 7/2013 |
| WO | WO 2008/001667 | A1 | 1/2008 |

OTHER PUBLICATIONS

Extended European Search Report dated Oct. 12, 2021 in corresponding European Application No. 19868322.9.
International Search Report (PCT/ISA/210) issued in PCT/JP2019/038400, dated Nov. 26, 2019.

* cited by examiner

REFRIGERATION CYCLE DEVICE

CROSS REFERENCE TO RELATED APPLICATIONS

This application is a Continuation of PCT International Application No. PCT/JP2019/038400, filed on Sep. 27, 2019, which claims priority under 35 U.S.C. 119(a) to Patent Application No. 2018-187369, filed in Japan on Oct. 2, 2018, all of which are hereby expressly incorporated by reference into the present application.

TECHNICAL FIELD

The present disclosure relates to a refrigeration cycle device in which an expansion mechanism that causes power to be produced by decompressing a refrigerant is provided at a refrigerant circuit.

BACKGROUND ART

Hitherto, there has existed a refrigeration cycle device that includes a refrigerant circuit having a compressor, a heat-source-side heat exchanger, and a use-side heat exchanger. As such a refrigeration cycle device, as described in Patent Literature 1 (Japanese Unexamined Patent Application Publication No. 2013-139938), there exists a device in which an expander (expansion mechanism) that causes power to be produced by decompressing a refrigerant is provided at a refrigerant circuit.

SUMMARY

A refrigeration cycle device according to a first aspect includes a main refrigerant circuit and a sub-refrigerant circuit. The main refrigerant circuit has a main compressor, a main heat-source-side heat exchanger, a main use-side heat exchanger, and a main expansion mechanism. The main compressor compresses a main refrigerant. The main heat-source-side heat exchanger is a heat exchanger that functions as a radiator of the main refrigerant. The main use-side heat exchanger is a heat exchanger that functions as an evaporator of the main refrigerant. The main expansion mechanism is an expander including an expansion element of a rotary or scroll type that causes power to be produced by decompressing the main refrigerant that flows between the main heat-source-side heat exchanger and the main use-side heat exchanger. The main refrigerant circuit has a sub-use-side heat exchanger that functions as a cooler of the main refrigerant that flows between the main expansion mechanism and the main use-side heat exchanger. The sub-refrigerant circuit has a sub-compressor, a sub-heat-source-side heat exchanger, and the sub-use-side heat exchanger. The sub-compressor is a compressor that compresses the sub-refrigerant. The sub-heat-source-side heat exchanger is a heat exchanger that functions as a radiator of the sub-refrigerant. The sub-use-side heat exchanger is a heat exchanger that functions as an evaporator of the sub-refrigerant and that cools the main refrigerant that flows between the main expansion mechanism and the main use-side heat exchanger.

DESCRIPTION OF EMBODIMENTS

A refrigeration cycle device is described below based on the drawings.

(1) Configuration

Figure 1:
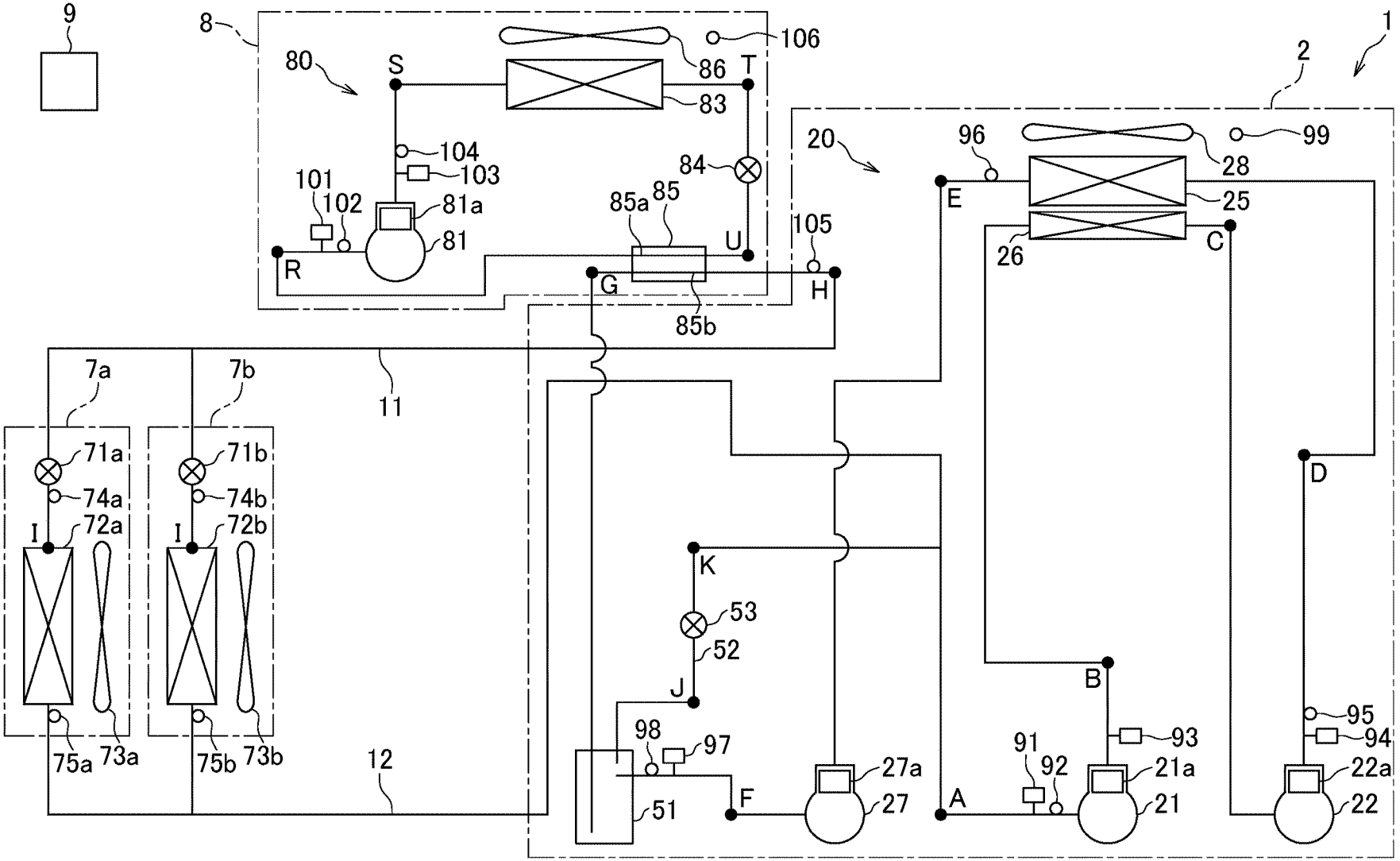
FIG. 1 is a schematic view of a configuration of a refrigeration cycle device according to an embodiment of the present disclosure.

FIG. 1 is a schematic view of a configuration of a refrigeration cycle device 1 according to an embodiment of the present disclosure.

<Circuit Configuration>

The refrigeration cycle device 1 includes a main refrigerant circuit 20 in which a main refrigerant circulates and a sub-refrigerant circuit 80 in which a sub-refrigerant circulates, and is a device that air-conditions (here, cools) the interior of a room.

—Main Refrigerant Circuit—

The main refrigerant circuit 20 primarily has main compressors 21 and 22, a main heat-source-side heat exchanger 25, main use-side heat exchangers 72*a* and 72*b*, a main expansion mechanism 27, and a sub-use-side heat exchanger 85. The main refrigerant circuit 20 has an intermediate heat exchanger 26, a gas-liquid separator 51, a degassing pipe 52, and main use-side expansion mechanisms 71*a* and 71*b*. As the main refrigerant, carbon dioxide is sealed in the main refrigerant circuit 20.

The main compressors 21 and 22 are devices that compress the main refrigerant. The first main compressor 21 is a compressor in which a low-stage-side compression element 21*a*, such as a rotary type or a scroll type, is driven by a driving mechanism, such as a motor or an engine. The second main compressor 22 is a compressor in which a high-stage-side compression element 22*a*, such as a rotary type or a scroll type, is driven by a driving mechanism, such as a motor or an engine. The main compressors 21 and 22 constitute a multi-stage compressor (here, a two-stage compressor) in which, at the first main compressor 21 on the low-stage side, the main refrigerant is compressed and then discharged, and in which, at the second main compressor 22 on the high stage side, the main refrigerant discharged from the first main compressor 21 is compressed.

The intermediate heat exchanger 26 is a device that causes the main refrigerant and outdoor air to exchange heat with each other, and, here, is a heat exchanger that functions as a cooler of a main refrigerant that flows between the first main compressor 21 and the second main compressor 22.

The main heat-source-side heat exchanger 25 is a device that causes the main refrigerant and outdoor air to exchange heat with other, and, here, is a heat exchanger that functions as a radiator of the main refrigerant. One end (inlet) of the main heat-source-side heat exchanger 25 is connected to a discharge side of the second main compressor 22, and the other end (outlet) of the main heat-source-side heat exchanger 25 is connected to the main expansion mechanism 27.

The main expansion mechanism 27 is a device that decompresses the main refrigerant, and, here, is an expansion device that causes power to be produced by decompressing a main refrigerant that flows between the main heat-source-side heat exchanger 25 and the main use-side heat exchangers 72*a* and 72*b*. Specifically, the main expansion mechanism 27 is an expansion device that isentropically decompresses the main refrigerant by using an expansion element 27*a*, such as a rotary type or a scroll type, and drives a generator by power that is generated at the expansion element 27*a* to recover the power.

The main expansion mechanism 27 is provided between the other end (outlet) of the main heat-source-side heat exchanger 25 and the gas-liquid separator 51.

The gas-liquid separator 51 is a device that causes the main refrigerant to conduct gas-liquid separation, and, here, is a container at which the main refrigerant that has been decompressed at the main expansion mechanism 27 undergoes the gas-liquid separation. Specifically, the gas-liquid separator 51 is provided between the main expansion mechanism 27 and the sub-use-side heat exchanger 85 (one end of a second sub-flow path 85*b*).

The degassing pipe 52 is a refrigerant pipe in which the main refrigerant flows, and, here, is a refrigerant pipe that extracts the main refrigerant in a gas state from the gas-liquid separator 51 and sends the main refrigerant in the gas state to a suction side of each of the main compressors 21 and 22. Specifically, the degassing pipe 52 is a refrigerant pipe that sends the main refrigerant in the gas state extracted from the gas-liquid separator 51 to the suction side of the first main compressor 21. One end of the degassing pipe 52 is connected so as to communicate with an upper space of the gas-liquid separator 51, and the other end of the degassing pipe 52 is connected to the suction side of the first main compressor 21.

The degassing pipe 52 has a degassing expansion mechanism 53 as a main intermediate-pressure adjusting valve. The degassing expansion mechanism 53 is a device that decompresses the main refrigerant, and, here, is an expansion mechanism that decompresses a main refrigerant that flows in the degassing pipe 52. The degassing expansion mechanism 53 is, for example, an electrically powered expansion valve.

The sub-use-side heat exchanger 85 is a device that causes the main refrigerant and the sub-refrigerant to exchange heat with each other, and, here, is a heat exchanger that functions as a cooler of a main refrigerant that flows between the main expansion mechanism 27 and the main use-side heat exchangers 72*a* and 72*b*. Specifically, the sub-use-side heat exchanger 85 is a heat exchanger that cools a main refrigerant that flows between the gas-liquid separator 51 and the main use-side heat exchangers 72*a* and 72*b* (the main use-side expansion mechanisms 71*a* and 71*b*).

The main use-side expansion mechanisms 71*a* and 71*b* are each a device that decompresses the main refrigerant, and, here, are each an expansion mechanism that decompresses the main refrigerant that flows between the main expansion mechanism 27 and the main use-side heat exchangers 72*a* and 72*b*. Specifically, the main use-side expansion mechanisms 71*a* and 71*b* are each provided between the sub-use-side heat exchanger 85 (the other end of the second sub-flow path 85*b*) and one end (inlet) of a corresponding one of the main use-side heat exchangers 72*a* and 72*b*. The main use-side expansion mechanisms 71*a* and 71*b* are each, for example, an electrically powered expansion valve.

The main use-side heat exchangers 72*a* and 72*b* are each a device that causes the main refrigerant and indoor air to exchange heat with each other, and, here, are each a heat exchanger that functions as an evaporator of the main refrigerant. The one end (inlet) of each of the main use-side heat exchangers 72*a* and 72*b* is connected to a corresponding one of the main use-side expansion mechanisms 71*a* and 71*b*, and the other end (outlet) of each of the main use-side heat exchangers 72*a* and 72*b* is connected to the suction side of the first compressor 21.

—Sub-Refrigerant Circuit—

The sub-refrigerant circuit 80 primarily has a sub-compressor 81, a sub-heat-source-side heat exchanger 83, and the sub-use-side heat exchanger 85. The sub-refrigerant circuit 80 has a sub-expansion mechanism 84. As the sub-refrigerant, a HFC refrigerant (such as R32), a HFO refrigerant (such as R1234yf or R1234ze), or a mixture refrigerant in which the HFC refrigerant and the HFO refrigerant are mixed (such as R452B) is sealed in the sub-refrigerant circuit 80, the HFC refrigerant, the HFO refrigerant, and the mixture refrigerant having a GWP (global warming potential) that is 750 or less. Note that the sub-refrigerant is not limited thereto, and may be a natural refrigerant having a coefficient of performance that is higher than that of carbon dioxide (such as propane or ammonia).

The sub-compressor 81 is a device that compresses the sub-refrigerant. The sub-compressor 81 is a compressor in which a compression element 81*a*, such as a rotary type or a scroll type, is driven by a driving mechanism, such as a motor or an engine.

The sub-heat-source-side heat exchanger 83 is a device that causes the sub-refrigerant and outdoor air to exchange heat with each other, and, here, is a heat exchanger that functions as a radiator of the sub-refrigerant. One end (inlet) of the sub-heat-source-side heat exchanger 83 is connected to a discharge side of the sub-compressor 81, and the other end (outlet) of the sub-heat-source-side heat exchanger 83 is connected to the sub-expansion mechanism 84.

The sub-expansion mechanism 84 is a device that decompresses the sub-refrigerant, and, here, is an expansion mechanism that decompresses a sub-refrigerant that flows between the sub-heat-source-side heat exchanger 83 and the sub-use-side heat exchanger 85. Specifically, the sub-expansion mechanism 84 is provided between the other end (outlet) of the sub-heat-source-side heat exchanger 83 and the sub-use-side heat exchanger 85 (one end of a first sub-flow path 85*a*). The sub-expansion mechanism 84 is, for example, an electrically powered expansion valve.

As described above, the sub-use-side heat exchanger 85 is a device that causes the main refrigerant and the sub-refrigerant to exchange heat with each other, and, here, functions as an evaporator of the sub-refrigerant and is a heat exchanger that cools the main refrigerant that flows between the main expansion mechanism 27 and the main use-side heat exchangers 72*a* and 72*b*. Specifically, the sub-use-side heat exchanger 85 is a heat exchanger that cools the main refrigerant that flows between the gas-liquid separator 51 and the main use-side heat exchangers 72*a* and 72*b* (the main use-side expansion mechanisms 71*a* and 71*b*) by using a refrigerant that flows in the sub-refrigerant circuit 80. The sub-use-side heat exchanger 85 has the first sub-flow path 85*a* in which the sub-refrigerant is caused to flow between the sub-expansion mechanism 84 and a suction side of the sub-compressor 81, and the second sub-flow path 85*b* in which the main refrigerant is caused to flow between the gas-liquid separator 51 and the main use-side heat exchangers 72*a* and 72*b*. One end (inlet) of the first sub-flow path 85*a* is connected to the sub-expansion mechanism 84, and the other end (outlet) of the first sub-flow path 85*a* is connected to the suction side of the sub-compressor 81. The one end (inlet) of the second sub-flow path 85*b* is connected to the gas-liquid separator 51, and the other end (outlet) of the second sub-flow path 85*b* is connected to the main use-side expansion mechanisms 71*a* and 71*b*.

<Unit Configuration>

The devices constituting the main refrigerant circuit 20 and the sub-refrigerant circuit 80 above are provided at a heat-source unit 2, a plurality of use units 7*a* and 7*b*, and a sub-unit 8. The use units 7*a* and 7*b* are each provided in correspondence with a corresponding one of the main use-side heat exchangers 72*a* and 72*b*.

—Heat-Source Unit—

The heat-source unit 2 is disposed outdoors. The main refrigerant circuit 20 excluding the sub-use-side heat exchanger 85, the main use-side expansion mechanisms 71*a* and 71*b*, and the main use-side heat exchangers 72*a* and 72*b* is provided at the heat-source unit 2.

A heat-source-side fan 28 for sending outdoor air to the main heat-source-side heat exchanger 25 and the intermediate heat exchanger 26 is provided at the heat-source unit 2. The heat-source-side fan 28 is a fan in which a blowing element, such as a propeller fan, is driven by a driving mechanism, such as a motor.

The heat-source unit 2 is provided with various sensors. Specifically, a pressure sensor 91 and a temperature sensor 92 that detect the pressure and the temperature of a main refrigerant on the suction side of the first main compressor 21 are provided. A pressure sensor 93 that detects the pressure of a main refrigerant on a discharge side of the first main compressor 21 is provided. A pressure sensor 94 and a temperature sensor 95 that detect the pressure and the temperature of a main refrigerant on a discharge side of the second main compressor 21 are provided. A temperature sensor 96 that detects the temperature of a main refrigerant on the other end (outlet) of the main heat-source-side heat exchanger 25 is provided. A pressure sensor 97 and a temperature sensor 98 that detect the pressure and the temperature of a main refrigerant at the gas-liquid separator 51 are provided. A temperature sensor 105 that detects the temperature of a main refrigerant on the other end of the sub-use-side heat exchanger 85 (the other end of the second sub-flow path 85*b*) is provided. A temperature sensor 99 that detects the temperature of outdoor air (outside air temperature) is provided.

—Use Units—

The use units 7*a* and 7*b* are disposed indoors. The main use-side expansion mechanisms 71*a* and 71*b* and the main use-side heat exchangers 72*a* and 72*b* of the main refrigerant circuit 20 are provided at a corresponding one of the use units 7*a* and 7*b*.

Use-side fans 73*a* and 73*b* for sending indoor air to a corresponding one of the main use-side heat exchangers 72*a* and 72*b* are provided at a corresponding one of the use units 7*a* and 7*b*. Each of the indoor fans 73*a* and 73*b* is a fan in which a blowing element, such as a centrifugal fan or a multiblade fan, is driven by a driving mechanism, such as a motor.

The use units 7*a* and 7*b* are provided with various sensors. Specifically, temperature sensors 74*a* and 74*b* that detect the temperature of a main refrigerant on one end (inlet) side of a corresponding one of the main use-side heat exchangers 72*a* and 72*b*, and temperature sensors 75*a* and 75*b* that detect the temperature of a main refrigerant on the other end (outlet) side of a corresponding one of the main use-side heat exchangers 72*a* and 72*b* are provided.

—Sub-Unit—

The sub-unit 8 is disposed outdoors. The sub-refrigerant circuit 80 and a part of a refrigerant pipe that constitutes the main refrigerant circuit 20 (a part of the refrigerant pipe that is connected to the sub-use-side heat exchanger 85 and in which the main refrigerant flows) are provided at the sub-unit 8.

A sub-side fan 86 for sending outdoor air to the sub-heat-source-side heat exchanger 83 is provided at the sub-unit 8. The sub-side fan 86 is a fan in which a blowing element, such as a propeller fan, is driven by a driving mechanism, such as a motor.

Here, although the sub-unit 8 is provided adjacent to the heat-source unit 2 and the sub-unit 8 and the heat-source unit 2 are substantially integrated with each other, it is not limited thereto. The sub-unit 8 may be provided apart from the heat-source unit 2, or all structural devices of the sub-unit 8 may be provided at the heat-source unit 2 and the sub-unit 8 may be omitted.

The sub-unit 8 is provided with various sensors. Specifically, a pressure sensor 101 and a temperature sensor 102 that detect the pressure and the temperature of a sub-refrigerant on the suction side of the sub-compressor 81 are provided. A pressure sensor 103 and a temperature sensor 104 that detect the pressure and the temperature of a sub-refrigerant on the discharge side of the sub-compressor 81 are provided. A temperature sensor 106 that detects the temperature of outdoor air (outside air temperature) is provided.

—Main Refrigerant Connection Pipes—

The heat-source unit 2 and the use units 7*a* and 7*b* are connected to each other by main refrigerant connection pipes 11 and 12 that constitute a part of the main refrigerant circuit 20.

The first main refrigerant connection pipe 11 is a part of a pipe that connects the sub-use-side heat exchanger 85 (the other end of the second sub-flow path 85*b*) and the main use-side expansion mechanisms 71*a* and 71*b*.

The second main refrigerant connection pipe 12 is a part of a pipe that connects the other ends of the corresponding main use-side heat exchangers 72*a* and 72*b* and the suction side of the first main compressor 21.

—Control Unit—

The structural devices of the heat-source unit 2, the use units 7*a* and 7*b*, and the sub-unit 8, including the structural devices of the main refrigerant circuit 20 and the sub-refrigerant circuit 80 above, are controlled by the control unit 9. The control unit 9 is formed by communication-connection of, for example, a control board at which the heat-source unit 2, the use units 7*a* and 7*b*, and the sub-unit 8 are provided, and is formed so as to be capable of receiving, for example, detection signals of the various sensors 74*a*, 74*b*, 75*a*, 75*b*, 91 to 99, and 101 to 106. For convenience sake, FIG. 1 illustrates the control unit 9 at a position situated away from, for example, heat-source unit 2, the use units 7*a* and 7*b*, and the sub-unit 8. In this way, the control unit 9, based on, for example, the detection signals of, for example, the various sensors 74*a*, 74*b*, 75*a*, 75*b*, 91 to 99, and 101 to 106, controls the structural devices 21, 22, 27, 28, 53, 71*a*, 71*b*, 73*a*, 73*b*, 81, 84, and 86, that is, controls the operation of the entire refrigeration cycle device 1.

(2) Operation

Figure 2:
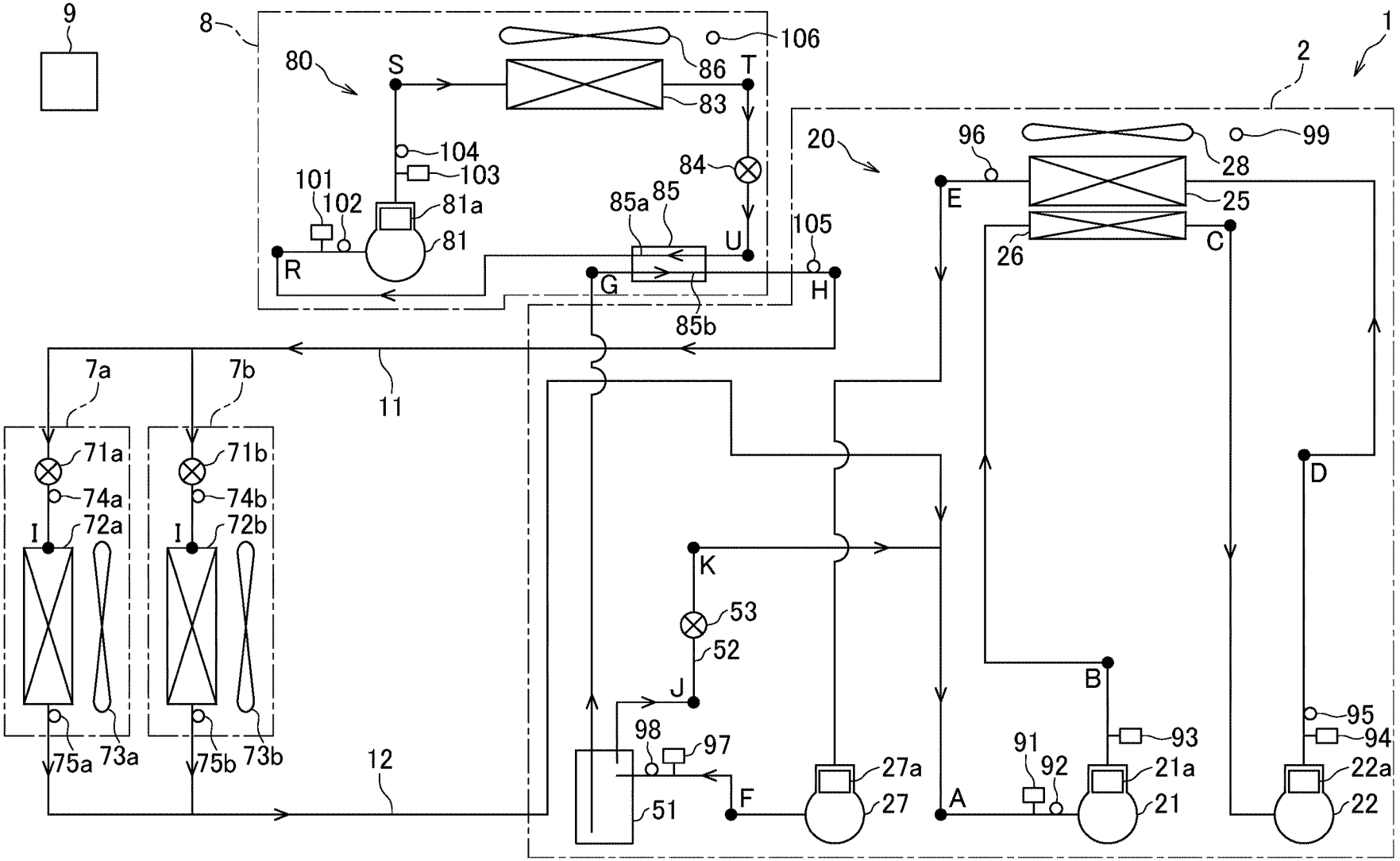
FIG. 2 illustrates flow of a refrigerant in the refrigeration cycle device in a cooling operation.
Figure 3:
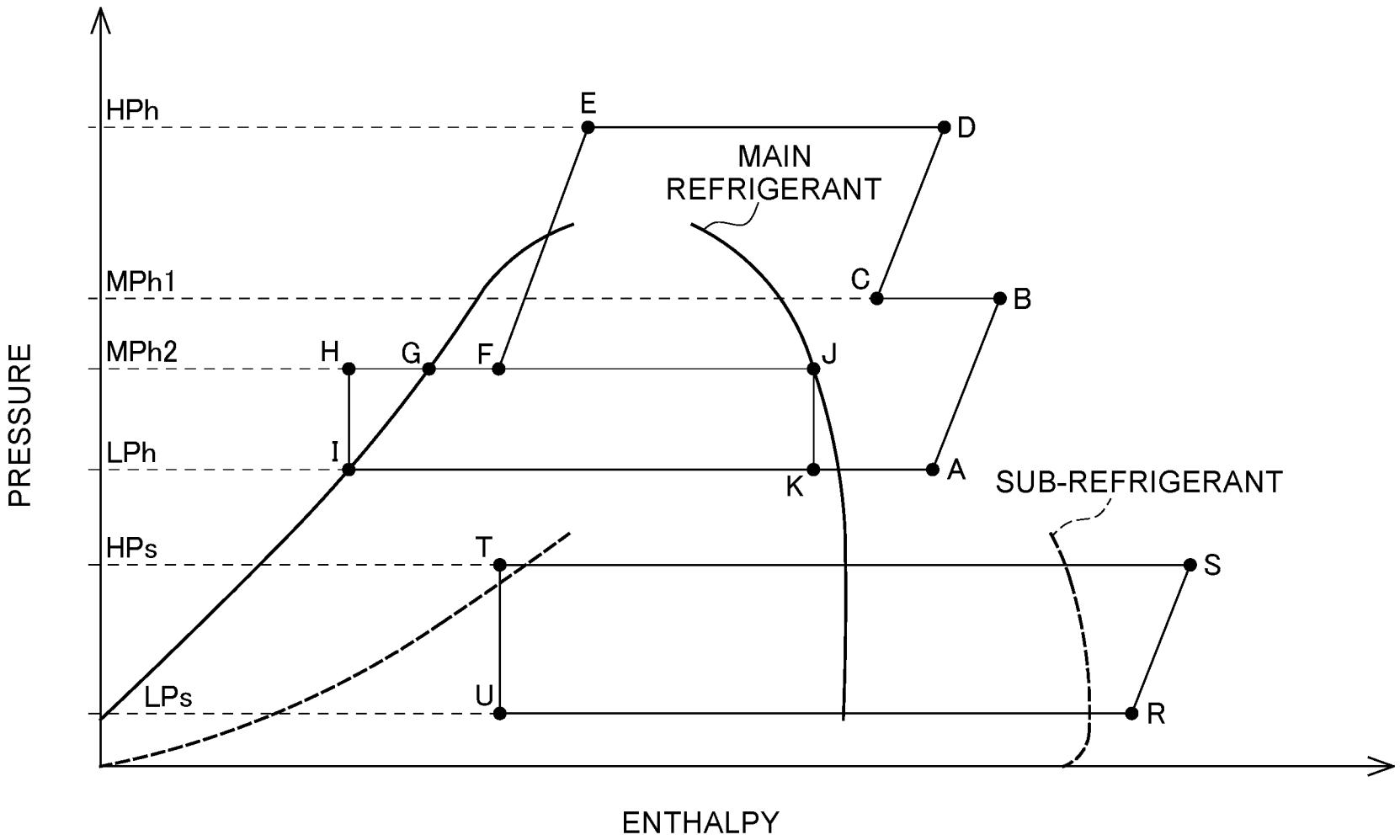
FIG. 3 is a pressure-enthalpy diagram illustrating the refrigeration cycle at the time of the cooling operation.
Figure 4:
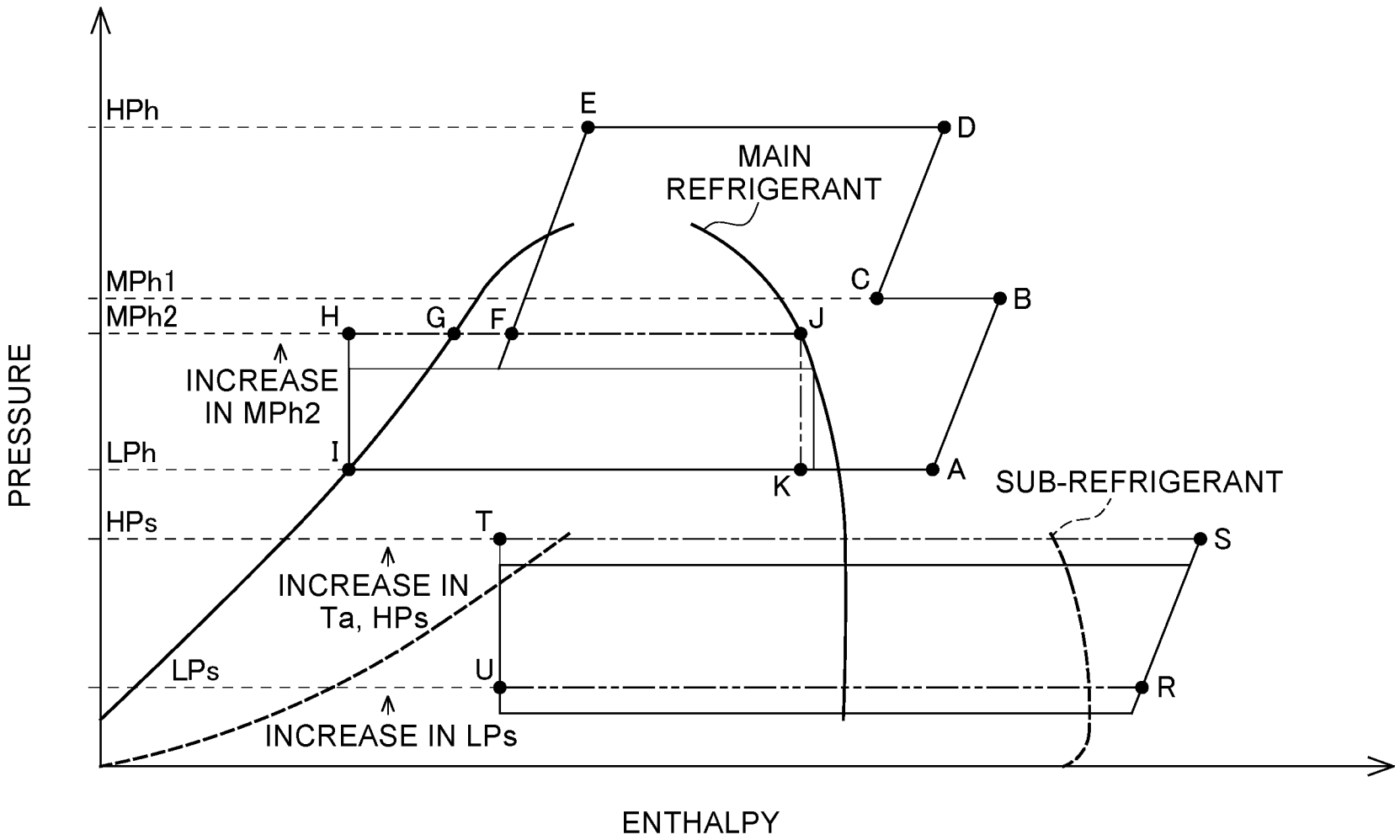
FIG. 4 illustrates control of an intermediate pressure in a refrigeration cycle of a main refrigerant circuit, and is a pressure-enthalpy diagram illustrating the refrigeration cycle when outside air temperature has increased.
Figure 5:
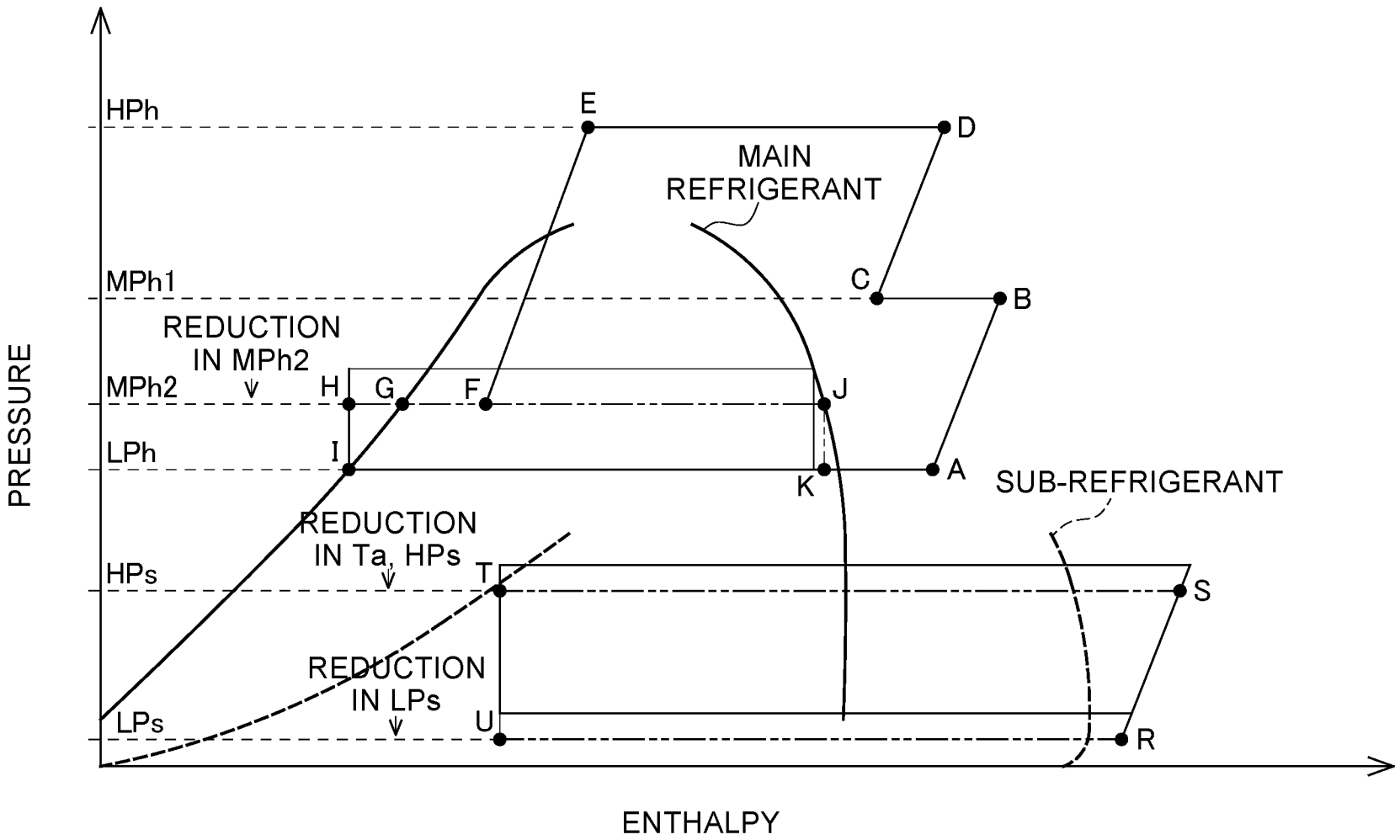
FIG. 5 illustrates control of the intermediate pressure in the refrigeration cycle of the main refrigerant circuit, and is a pressure-enthalpy diagram illustrating the refrigeration cycle when the outside air temperature has been reduced.
Figure 6:
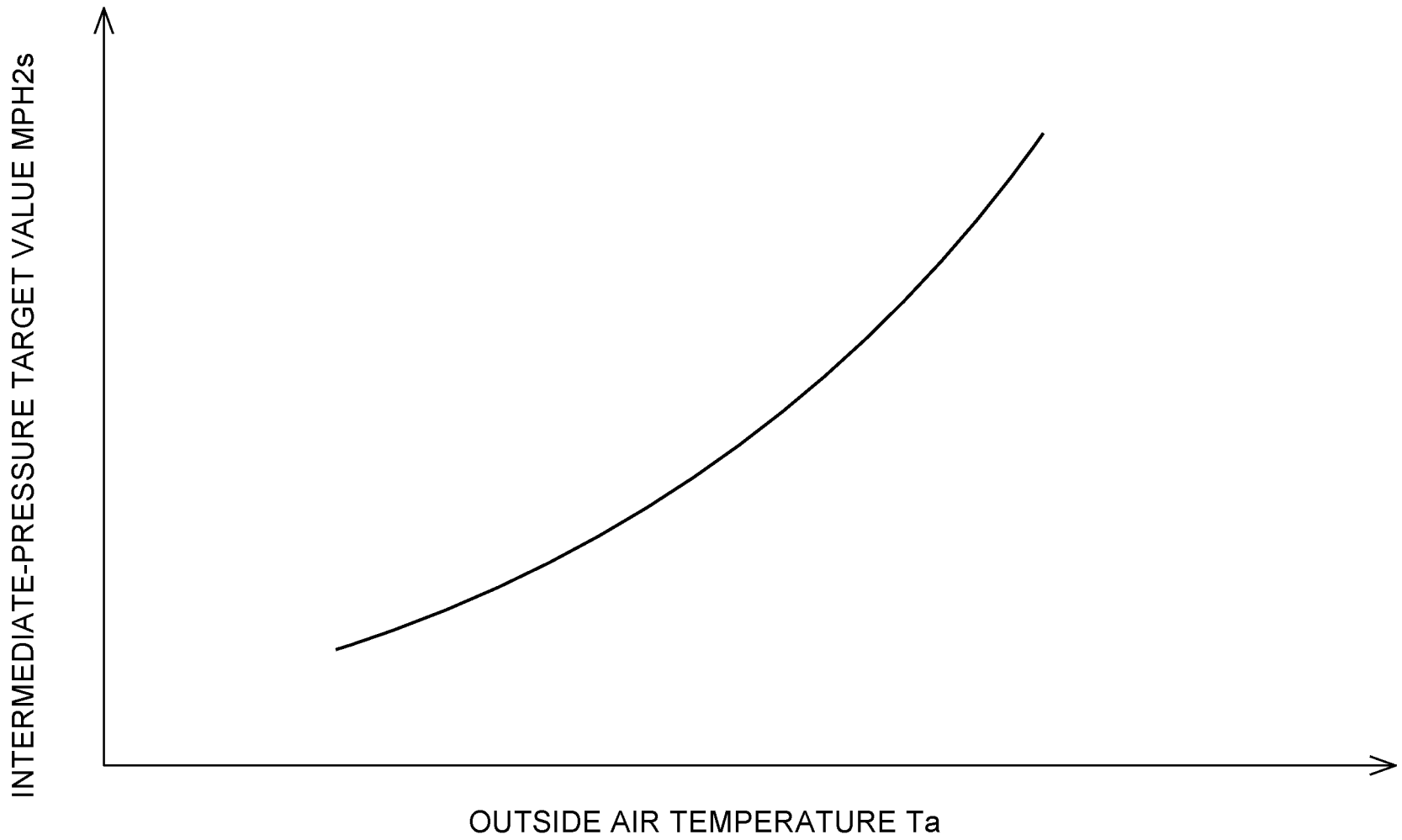
FIG. 6 shows a relationship between the outside air temperature and a target value of the intermediate pressure in the refrigeration cycle of the main refrigerant circuit.

Next, the operation of the refrigeration cycle device 1 is described by using FIGS. 2 to 6. Here, FIG. 2 illustrates flow of a refrigerant in the refrigeration cycle device 1 in a cooling operation. FIG. 3 is a pressure-enthalpy diagram illustrating the refrigeration cycle at the time of the cooling operation. FIG. 4 illustrates control of an intermediate pressure MPh2 in a refrigeration cycle of the main refrigerant circuit 20, and is a pressure-enthalpy diagram illustrating the refrigeration cycle when outside air temperature Ta has increased. FIG. 5 illustrates control of the intermediate pressure MPh2 in the refrigeration cycle of the main refrigerant circuit 20, and is a pressure-enthalpy diagram illustrating the refrigeration cycle when the outside air temperature Ta has been lowered. FIG. 6 shows a relationship between the outside air temperature Ta and a target value MPh2*s* of the intermediate pressure in the refrigeration cycle of the main refrigerant circuit 20.

The refrigeration cycle device 1 is capable of performing, as an air-conditioning operation of the interior of a room, a cooling operation that cools indoor air with the main use-side heat exchangers 72*a* and 72*b* functioning as evaporators of the main refrigerant. In addition, here, at the time of the cooling operation, an isentropic decompressing operation on the main refrigerant is performed by the main expansion mechanism 27, and the main refrigerant that flows between the main expansion mechanism 27 and the main use-side heat exchangers 72*a* and 72*b* is cooled by using the sub-refrigerant circuit 80. Note that the cooling operation including these operations is performed by the control unit 9.

<Cooling Operation>

At the main refrigerant circuit 20, the main refrigerant (refer to point A in FIGS. 2 and 3) at a low pressure (LPh) in the refrigeration cycle is sucked by the first main compressor 21, and, at the first main compressor 21, the main refrigerant is compressed up to an intermediate pressure (MPh1) in the refrigeration cycle and is discharged (refer to point B in FIGS. 2 and 3).

The main refrigerant at the intermediate pressure discharged from the first main compressor 21 is sent to the intermediate heat exchanger 26, and, at the intermediate heat exchanger 26, exchanges heat with outdoor air that is sent by the heat-source-side fan 28 and is cooled (refer to point C in FIGS. 2 and 3).

The main refrigerant at the intermediate pressure that has been cooled at the intermediate heat exchanger 26 is sucked by the second main compressor 22, and, at the second main compressor 22, is compressed up to a high pressure (HPh) in the refrigeration cycle and is discharged (refer to point D in FIGS. 2 and 3). Here, the main refrigerant at the high pressure discharged from the second main compressor 22 has a pressure that exceeds the critical pressure of the main refrigerant.

The main refrigerant at the high pressure discharged from the second main compressor 22 is sent to the main heat-source-side heat exchanger 25, and, at the main heat-source-side heat exchanger 25, exchanges heat with outdoor air that is sent by the heat-source-side fan 28 and is cooled (refer to point E in FIGS. 2 and 3).

The main refrigerant at the high pressure that has been cooled at the main heat-source-side heat exchanger 25 is sent to the main expansion mechanism 27, and, at the main expansion mechanism 27, is isentropically decompressed up to the intermediate pressure (MPh2) in the refrigeration cycle, and is brought into a gas-liquid two-phase state (refer to point F in FIGS. 2 and 3). Here, the intermediate pressure (MPh2) is a pressure that is lower than the intermediate pressure (MPh1). Power that is produced by isentropically decompressing the main refrigerant is recovered by driving the generator of the main expansion mechanism 27.

The main refrigerant at the intermediate pressure that has been decompressed at the main expansion mechanism 27 is sent to the gas-liquid separator 51, and, at the gas-liquid separator 51, is separated into a main refrigerant in a gas state (refer to point J in FIGS. 2 and 3) and a main refrigerant in a liquid state (refer to point G in FIGS. 2 and 3).

The main refrigerant at the intermediate pressure and in the gas state that has been separated at the gas-liquid separator 51 is extracted from the gas-liquid separator 51 to the degassing pipe 52 in accordance with the opening degree of the degassing expansion mechanism 53. The main refrigerant at the intermediate pressure and in the gas state that has been extracted to the degassing pipe 52 is decompressed up to the low pressure (LPh) (refer to point K in FIGS. 2 and 3) in the degassing expansion mechanism 53 and is sent to the suction side of the first main compressor 21.

The main refrigerant at the intermediate pressure and in the liquid state that has been separated at the gas-liquid separator 51 is sent to the sub-use-side heat exchanger 85 (second sub-flow path 85*b*).

On the other hand, at the sub-refrigerant circuit 80, the sub-refrigerant (refer to point R in FIGS. 2 and 3) at a low pressure (LPs) in the refrigeration cycle is sucked by the sub-compressor 81, and, at the sub-compressor 81, the sub-refrigerant is compressed up to a high pressure (HPs)) in the refrigeration cycle and is discharged (refer to point S in FIGS. 2 and 3).

The sub-refrigerant at the high pressure discharged from the sub-compressor 81 is sent to the sub-heat-source-side heat exchanger 83, and, at the sub-heat-source-side heat exchanger 83, exchanges heat with outdoor air that is sent by the sub-side fan 86 and is cooled (refer to point T in FIGS. 2 and 3).

The sub-refrigerant at the high pressure that has been cooled at the sub-heat-source-side heat exchanger 83 is sent to the sub-expansion mechanism 84, and, at the sub-expansion mechanism 84, is decompressed up to a low pressure and is brought into a gas-liquid two-phase state (refer to point U in FIGS. 2 and 3).

Then, at the sub-use-side heat exchanger 85, a main refrigerant at the intermediate pressure that flows in the second sub-flow path 85*b* exchanges heat with the sub-refrigerant at the low pressure and in the gas-liquid two-phase state that flows in the first sub-flow path 85*a*, and is cooled (refer to point H in FIGS. 2 and 3). In contrast, the sub-refrigerant at the low pressure and in the gas-liquid two-phase state that flows in the first sub-flow path 85*a* exchanges heat with the main refrigerant at the intermediate pressure that flows in the second sub-flow path 85*b* and is heated (refer to point R in FIGS. 2 and 3), and is sucked in on the suction side of the sub-compressor 81 again.

The main refrigerant at the intermediate pressure that has been cooled at the sub-heat-source-side heat exchanger 85 is sent to the main use-side expansion mechanisms 71*a* and 71*b* via the first main refrigerant connection pipe 11, and, at the main use-side expansion mechanisms 71*a* and 71*b*, is decompressed up to the low pressure (LPh) and is brought into a gas-liquid two-phase state (refer to point I in FIGS. 2 and 3).

The main refrigerant at the low pressure that has been decompressed at the main use-side expansion mechanisms 71*a* and 71*b* is sent to a corresponding one of the main use-side heat exchangers 72*a* and 72*b*, and, at the corresponding one of the main use-side heat exchangers 72*a* and 72*b*, exchanges heat with indoor air that is sent by a corresponding one of the use-side fans 73*a* and 73*b*, is heated, and evaporates (refer to the point A in FIGS. 2 and 3). In contrast, the indoor air exchanges heat with the main refrigerant at the low pressure and in the gas-liquid two-phase state that flows in the main use-side heat exchangers 72*a* and 72*b* and is cooled, as a result of which the interior of a room is cooled.

The main refrigerant at the low pressure that has evaporated at the main use-side heat exchangers 72*a* and 72*b* is sent to the suction side of the first main compressor 21 via the second main refrigerant connection pipe 12 and is, together with the main refrigerant that merges therewith from the degassing pipe 52, is sucked by the first main compressor 21 again. In this way, the cooling operation is performed.

<Control of Intermediate Pressure of Main Refrigerant Circuit>

Next, control of the intermediate pressure MPh2 of the main refrigerant circuit 20 (the pressure of the main refrigerant that flows in the sub-use-side heat exchanger 85) at the time of the cooling operation is described.

In the refrigeration cycle device 1 above that isentropically decompresses the main refrigerant by using the main expansion mechanism 27 and that cools the main refrigerant that flows between the main expansion mechanism 27 and the main use-side heat exchangers 72*a* and 72*b* by using the sub-refrigerant circuit 80, the coefficient of performance COP of the entire refrigeration cycle device 1 is obtained by the following formula.

$$COP=Qe/(Wh+Ws-Wr)$$

Here, Qe is the evaporation capacity of the main use-side heat exchangers 72*a* and 72*b* (equivalent to an enthalpy difference between the points I and A in FIG. 3). Wh is the input power of the main refrigerant circuit 20 (primarily equivalent to the input power of the main compressors 21 and 22, and the enthalpy difference between the points A and B and between the points C and D in FIG. 3). Ws is the input power of the sub refrigerant circuit 80 (primarily equivalent to the input power of the sub-compressor 81 and the enthalpy difference between the points R and S in FIG. 3). Wr is the recovery power of the main expansion mechanism 27 (equivalent to the enthalpy difference between the points E and F in FIG. 3).

In addition, at the refrigeration cycle device 1, as shown in FIG. 4, as the outside air temperature Ta increases, the high pressure HPs in the refrigeration cycle of the sub-refrigerant circuit 80 increases and the input power Ws of the sub-refrigerant circuit 80 tends to increase. Therefore, the coefficient of performance COP of the entire refrigeration cycle device 1 tends to be reduced in accordance with the increase in the input power Ws of the sub-refrigerant circuit 80. In order to suppress this tendency, it is necessary to increase the low pressure LPs in the refrigeration cycle of the sub-refrigerant circuit 80 and to reduce the input power Ws of the sub-refrigerant circuit 80. In order to increase the low pressure LPs in the refrigeration cycle of the sub-refrigerant circuit 80, the temperature of the main refrigerant that exchanges heat with the sub-refrigerant in the sub-use-side heat exchanger 85 (that is, the main refrigerant that flows between the main expansion mechanism 27 and the main use-side heat exchangers 72*a* and 72*b*), that is, the pressure of the main refrigerant that flows in the sub-use-side heat exchanger 85 (the intermediate pressure MPh2 in the refrigeration cycle of the main refrigerant circuit 20) is to be increased. Here, when the pressure of the main refrigerant that flows in the sub-use-side heat exchanger 85 increases, the decompression width at the main expansion mechanism 27 (equivalent to the pressure difference between points E and F in FIG. 4) decreases, the recovery power Wr of the main expansion mechanism 27 decreases. However, since the amount of decrease in the input power Ws of the sub-refrigerant circuit 80 is large, the coefficient of performance COP of the entire refrigeration cycle device 1 can be maintained at a high level.

Therefore, here, as described above, the degassing expansion mechanism 53, serving as a main intermediate-pressure adjusting valve, is provided between the main expansion mechanism 27 and the main use-side heat exchangers 72*a* and 72*b*, and the control unit 9 performs control that, the higher the outside air temperature Ta is, decreases the opening degree of the main intermediate-pressure adjusting valve 53. Here, although the degassing expansion mechanism 53 is provided at the degassing pipe 52 that branches off from the gas-liquid separator 51 provided between the main expansion mechanism 27 and the main use-side heat exchangers 72*a* and 72*b*, the valve that is provided at such a branching tube is also provided between the main expansion mechanism 27 and the main use-side heat exchangers 72*a* and 72*b*.

Specifically, the control unit 9 controls the opening degree of the degassing expansion mechanism 53 on the basis of the intermediate pressure MPh2 in the refrigeration cycle of the main refrigerant circuit 20. For example, the control unit 9 controls the opening degree of the degassing expansion mechanism 53 so that the intermediate pressure MPh2 in the refrigeration cycle of the main refrigerant circuit 20 becomes the target value MPh2*s*. Here, as shown in FIG. 6, considering the coefficient of performance COP of the entire refrigeration cycle device 1, the target value MPh2*s* is set so as to increase as the outside air temperature Ta increases. The intermediate pressure MPh2 is detected by the pressure sensor 97, and the outside air temperature Ta is detected by the temperature sensors 99 and 106.

When such control is performed, the pressure of the main refrigerant that flows in the sub-use-side heat exchanger 85 (the intermediate pressure MPh2 in the refrigeration cycle of the main refrigerant circuit 20) changes. By changing the intermediate pressure MPh2 of the main refrigerant, the recovery power Wr of the main expansion mechanism 27 changes and the low pressure LPs in the refrigeration cycle of the sub-refrigerant circuit 80 also changes. Therefore, the input power Ws of the sub-refrigerant circuit 20 changes.

Here, by performing control that, the higher the outside air temperature Ta is, decreases the opening degree of the degassing expansion mechanism 53, serving as a main intermediate-pressure adjusting valve, and by changing the pressure of the main refrigerant that flows in the sub-use-side heat exchanger 85 (the intermediate pressure MPh2 in the refrigeration cycle of the main refrigerant circuit 20), the coefficient of performance COP of the entire refrigeration cycle device 1 can be maintained at a high level.

For example, in an operating condition in which the outside air temperature Ta and the high pressure HPs in the refrigeration cycle of the sub-refrigerant circuit 80 are high and in which the input power Ws of the sub-refrigerant circuit 80 tends to increase, control that sets the target value MPh2*s* to a high value and that decreases the opening degree of the degassing expansion mechanism 53, serving as a main intermediate-pressure adjusting valve, is performed.

Therefore, as shown in FIG. 4, the pressure of the main refrigerant that flows in the sub-use-side heat exchanger 85 (the intermediate pressure MPh2 in the refrigeration cycle of the main refrigerant circuit 20) is increased, and, thus, the low pressure LPs in the refrigeration cycle of the sub-refrigerant circuit 80 also increases. Therefore, the input power Ws of the sub-refrigerant circuit 80 decreases and the coefficient of performance COP of the entire refrigeration cycle device 1 is maintained at a high level. Note that, when the pressure MPh2 of the main refrigerant that flows in the sub-use-side heat exchanger 85 is increased, the decompression width in the main expansion mechanism 27 decreases, as a result of which the recovery power Wr of the main expansion mechanism 27 decreases. However, the amount of decrease is smaller than the amount of decrease in the input power Ws of the sub-refrigerant circuit 80, as a result of which the coefficient of performance COP of the entire refrigeration cycle device 1 can be maintained at a high level.

In contrast, in an operating condition in which the outside air temperature Ta and the high pressure HPs in the refrigeration cycle of the sub-refrigerant circuit 80 are low and in which the input power Ws of the sub-refrigerant circuit 80 tends to decrease, control that sets the target value MPh2*s* to a low value and that increases the opening degree of the degassing expansion mechanism 53, serving as a main intermediate-pressure adjusting valve, is performed.

Therefore, as shown in FIG. 5, the pressure of the main refrigerant that flows in the sub-use-side heat exchanger 85 (the intermediate pressure MPh2 in the refrigeration cycle of the main refrigerant circuit 20) is reduced, and, thus, the decompression width in the main expansion mechanism 27 is increased. Therefore, the recovery power Wr of the main expansion mechanism 27 is increased, and the coefficient of performance COP of the entire refrigeration cycle device 1 is maintained at a high level. Note that, when the pressure MPh2 of the main refrigerant that flows in the sub-use-side heat exchanger 85 is reduced, the low pressure LPs in the refrigeration cycle of the sub-refrigerant circuit 80 is reduced, as a result of which the input power Ws of the sub-refrigerant circuit 80 is increased. However, the amount of increase is smaller than the amount of increase in the recovery power Wr of the main expansion mechanism 27, as a result of which the coefficient of performance COP of the entire refrigeration cycle device 1 can be maintained at a high level.

(3) Features

Next, the features of the refrigeration cycle device 1 are described.

<A>

Here, as described above, the main expansion mechanism 27 that is the same as main expansion mechanisms known in the art and that causes power to be produced by decompressing the main refrigerant is provided at the main refrigerant circuit 20 in which the main refrigerant circulates, and the sub-refrigerant circuit 80 that differs from the main refrigerant circuit 20 and in which the sub-refrigerant circulates is provided. In addition, the sub-use-side heat exchanger 85 that is provided at the sub-refrigerant circuit 80 and that functions as an evaporator of the sub-refrigerant is provided at the main refrigerant circuit 20 so as to function as a heat exchanger that cools the main refrigerant that flows between the main expansion mechanism 27 and the main use-side heat exchangers 72*a* and 72*b*. Therefore, here, not only can the main refrigerant be isentropically decompressed by the main expansion mechanism 27 that is the same as expansion mechanisms known in the art, but also the main refrigerant that flows between the main expansion mechanism 27 and the main use-side heat exchangers 72*a* and 72*b* can be cooled by using the sub-refrigerant circuit 80. Consequently, here, even if, in decompressing the refrigerant by the main expansion mechanism 27, the enthalpy of the main refrigerant that is sent to the main use-side heat exchangers 72*a* and 72*b* is not sufficiently reduced (refer to the points F and G in FIG. 3), it is possible to sufficiently reduce the enthalpy of the main refrigerant that is sent to the main use-side heat exchangers 72*a* and 72*b* by the cooling operation using the sub-refrigerant circuit 80 (refer to the points H and I in FIG. 3). Thus, it is possible to increase an evaporation capacity Qe of the main use-side heat exchangers 72*a* and 72*b*.

In this way, here, in the refrigeration cycle device 1 in which the expansion mechanism 27 that causes power to be produced by decompressing the refrigerant is provided at the refrigerant circuit 20, even if, in decompressing the refrigerant by the expansion mechanism 27, the temperature of the refrigerant cannot be sufficiently reduced, it is possible to increase the evaporation capacity Qe of the use-side heat exchangers 72*a* and 72*b*.

In particular, here, since, as the main refrigerant, carbon dioxide having a coefficient of performance that is lower than that of, for example, a HFC refrigerant is used, the heat-dissipation capacity of the refrigerant in the main heat-source-side heat exchanger 25 is easily reduced. Therefore, when only the operation of decompressing the refrigerant by the expansion mechanism 27 is performed, the tendency that the evaporation capacity of the main use-side heat exchangers 72*a* and 72*b* becomes difficult to increase becomes noticeable. However, here, as described above, since it is possible to sufficiently reduce the enthalpy of the main refrigerant that is sent to the main use-side heat exchangers 72*a* and 72*b* by the cooling operation using the sub-refrigerant circuit 80, it is possible to realize the desired capacity even if carbon dioxide is used as the main refrigerant.

<B>

Here, as described above, the main refrigerant circuit 20 has the degassing expansion mechanism 53, serving as a main intermediate-pressure adjusting valve, between the main expansion mechanism 27 and the main use-side heat exchangers 72*a* and 72*b*. Here, although the degassing expansion mechanism 53 is provided at the degassing pipe 52 that branches off from the gas-liquid separator 51 provided between the main expansion mechanism 27 and the main use-side heat exchangers 72*a* and 72*b*, the valve that is provided at such a branching tube is also provided between the main expansion mechanism 27 and the main use-side heat exchangers 72*a* and 72*b*. Here, the control unit 9 controls the degassing expansion mechanism 53, serving as a main intermediate-pressure adjusting valve, in accordance with the outside air temperature Ta. Specifically, the control unit 9 performs the control that, the higher the outside air temperature Ta is, decreases the opening degree of the degassing expansion mechanism 53, serving as a main intermediate-pressure adjusting valve.

Therefore, here, it is possible to change the pressure of the main refrigerant that flows in the sub-use-side heat exchanger 85 (the intermediate pressure MPh2 in the refrigeration cycle of the main refrigerant circuit 20), and to maintain the coefficient of performance COP of the entire refrigeration cycle device 1 at a high level.

Specifically, in the operating condition in which the outside air temperature Ta and the high pressure HPs in the refrigeration cycle of the sub-refrigerant circuit 80 are high and in which the input power Ws of the sub-refrigerant circuit 80 tends to increase, since the opening degree of the degassing expansion mechanism 53, serving as a main intermediate-pressure adjusting valve, decreases, as shown in FIG. 4, the low pressure LPs in the refrigeration cycle of the sub-refrigerant circuit 80 increases, the input power Ws of the sub-refrigerant circuit 80 decreases, and the coefficient of performance COP is maintained at a high level.

In contrast, in the operating condition in which the outside air temperature Ta and the high pressure HPs in the refrigeration cycle of the sub-refrigerant circuit 80 are low and in which the input power Ws of the sub-refrigerant circuit 80 tends to decrease, since the opening degree of the degassing expansion mechanism 53, serving as a main intermediate-pressure adjusting valve, is increased, as shown in FIG. 5, the decompression width in the main expansion mechanism 27 is increased, the recovery power Wr of the main expansion mechanism 27 is increased, and the coefficient of performance COP is maintained at a high level.

<C>

Here, as described above, since carbon dioxide is used as the main refrigerant, and a natural refrigerant having a coefficient of performance that is higher than that of a refrigerant having a low GWP and that of carbon dioxide is used as the sub-refrigerant, it is possible to reduce environmental load, such as global warming.

(4) Modifications

<Modification 1>

In the embodiment above, the control unit 9 performs the control that, the higher the outside air temperature Ta is, decreases the opening degree of the degassing expansion mechanism 53, serving as a main intermediate-pressure adjusting valve.

However, the outside air temperature Ta is used as an index for high/low values of the high pressure HPs in the refrigeration cycle of the sub-refrigerant circuit 80 and for a tendency in an increase/decrease in the input power Ws of the sub-refrigerant circuit 80.

Therefore, instead of the outside air temperature Ta, the high pressure HPs in the refrigeration cycle of the refrigerant circuit 80 or the input power of the sub-refrigerant circuit 80 may be used. That is, the control unit 9 may perform the control that reduces the opening degree of the degassing expansion mechanism 53, serving as a main intermediate-pressure adjusting valve, in accordance with the high pressure HPs in the refrigeration cycle of the sub-refrigerant circuit 80, or the input power Ws of the sub-refrigerant circuit 80.

Specifically, when the high pressure HPs in the refrigeration cycle of the sub-refrigerant circuit 80 is increased, the control unit 9 performs the control that decreases the opening degree of the degassing expansion mechanism 53, serving as a main intermediate-pressure adjusting valve, and, when the high pressure HPs in the refrigeration cycle of the sub-refrigerant circuit 80 is reduced, the control unit 9 performs the control that increases the opening degree of the degassing expansion mechanism 53, serving as a main intermediate-pressure adjusting valve. When the input power Ws of the sub-refrigerant circuit 80 is increased, the control unit 9 performs the control that decreases the opening degree of the degassing expansion mechanism 53, serving as a main intermediate-pressure adjusting valve, and, when the input power Ws of the sub-refrigerant circuit 80 decreases, the control unit 9 performs the control that increases the opening degree of the degassing expansion mechanism 53, serving as a main intermediate-pressure adjusting valve.

Figure 7:
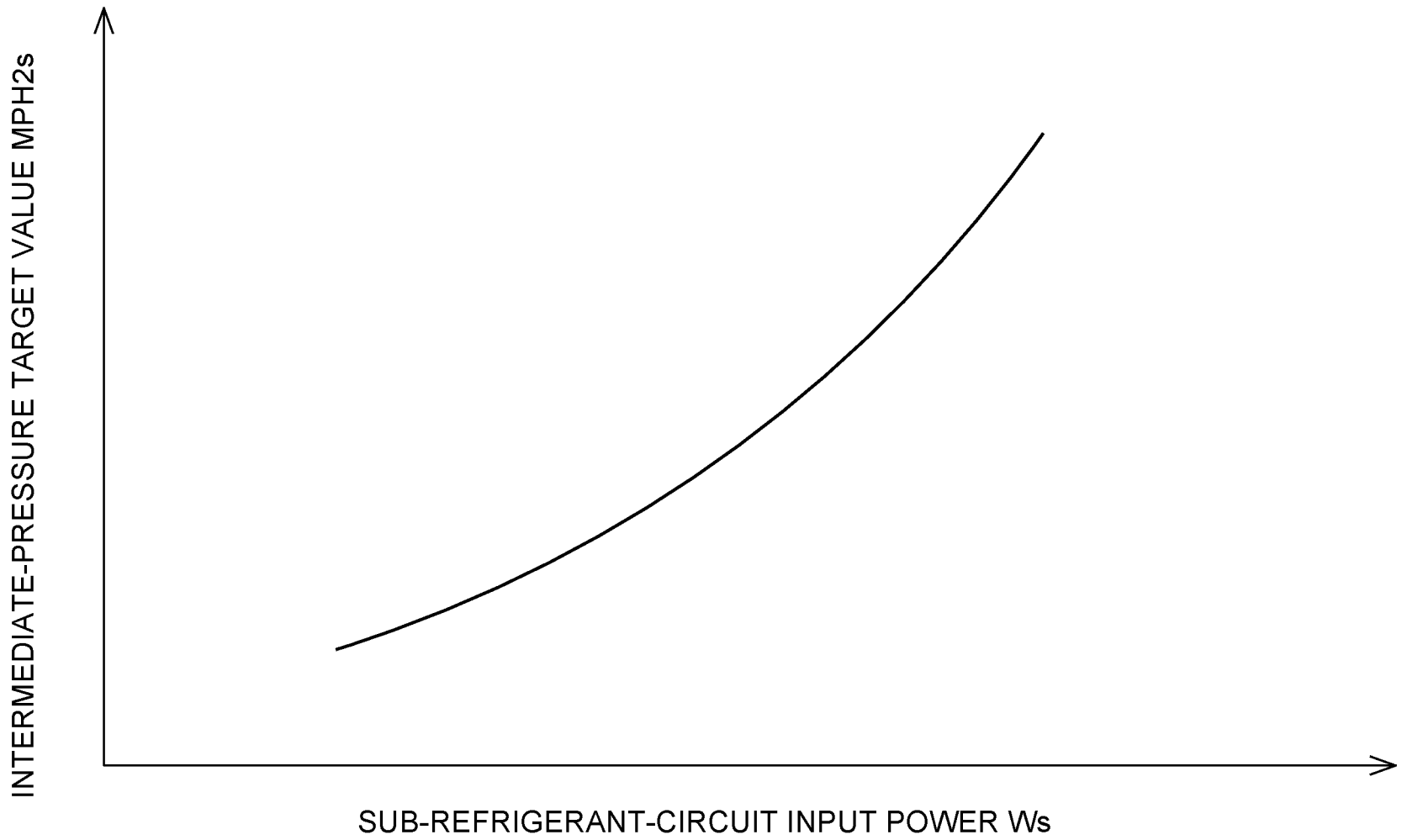
FIG. 7 shows a relationship between input power of a sub-refrigerant circuit and the target value of the intermediate pressure in the refrigeration cycle of the main refrigerant circuit in Modification 1.

Here, for example, when the input power Ws of the sub-refrigerant circuit 80 is used, as shown in FIG. 7, the target value MPh2*s* of the intermediate pressure MPh2 in the refrigeration cycle of the main refrigerant circuit 20 is prepared as a data table or a function of the input power Ws of the sub-refrigerant circuit 80. Note that the input power Ws of the sub-refrigerant circuit 80 may be obtained by estimation or calculation from the outside air temperature Ta or a current value of the sub-compressor 81.

Even in this case, as in the embodiment above, the intermediate pressure MPh2 in the refrigeration cycle of the main refrigerant circuit 20 can be controlled.

<Modification 2>

In the embodiment above and Modification 1, the degassing expansion mechanism 53 is used as a main intermediate-pressure adjusting valve.

However, the main intermediate-pressure adjusting valve is not limited to the degassing expansion mechanism 53, and any device can be used as long as the main intermediate-pressure adjusting valve is a valve that is provided between the main expansion mechanism 27 and the use-side heat exchangers 72*a* and 72*b*.

Figure 8:
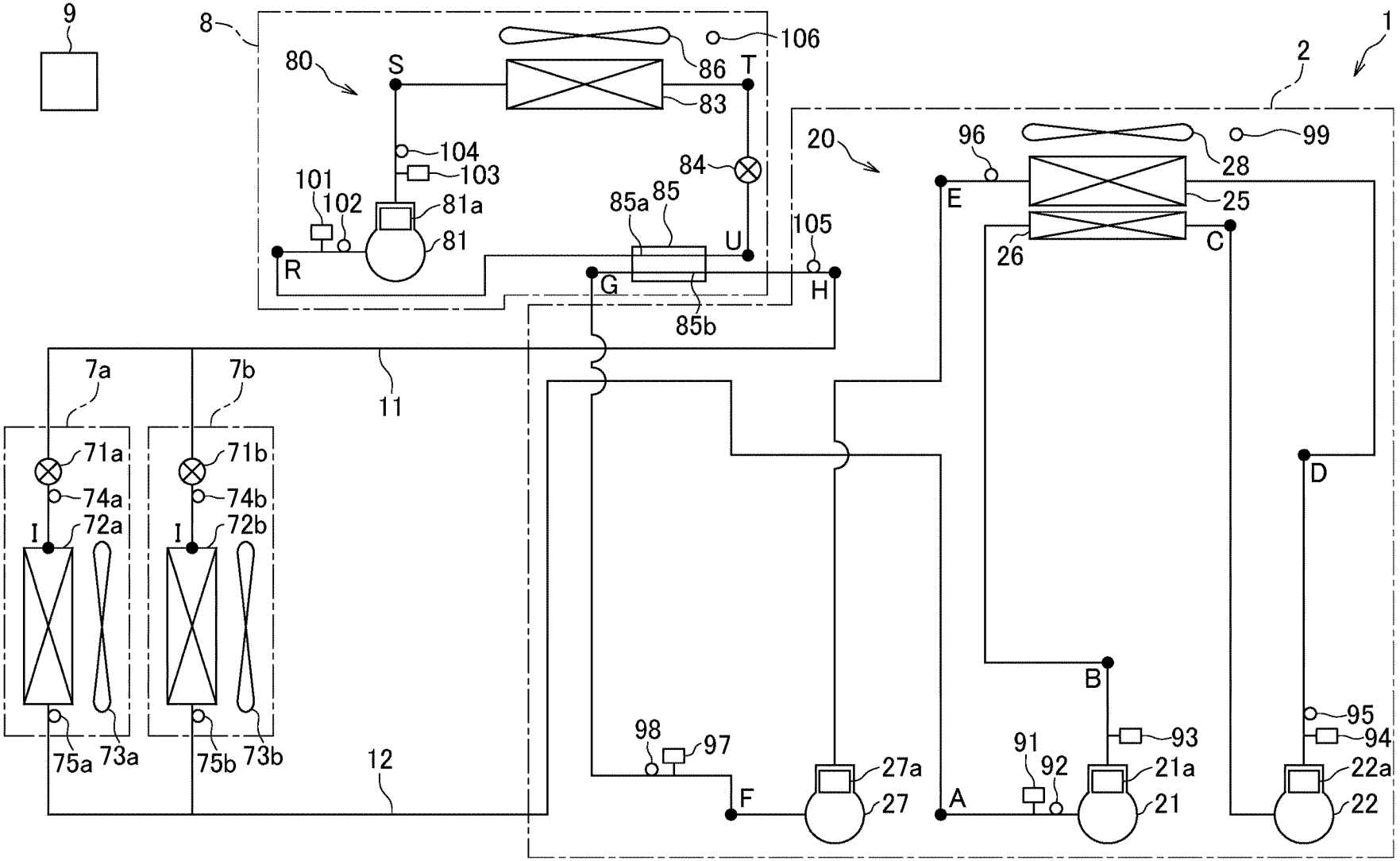
FIG. 8 is a schematic view of a configuration of a refrigeration cycle device of Modification 2.

For example, as shown in FIG. 8, in a structure of the main refrigerant circuit 20 that does not have the gas-liquid separator 51 and the degassing pipe 52 (including the degassing expansion mechanism 53), the main use-side expansion mechanisms 71*a* and 71*b* may be used as main intermediate-pressure adjusting valves.

Specifically, the opening degree of the main use-side expansion mechanisms 71*a* and 71*b*, serving as the main intermediate-pressure adjusting valves, is controlled in accordance with the input power Ws of the sub-refrigerant circuit 80, or control that, the higher the outside air temperature Ta is, decreases the opening degree of the main use-side expansion mechanisms 71*a* and 71*b*, serving as the main intermediate-pressure adjusting valves, is performed.

Even in this case, as in the embodiment above and Modification 1, the intermediate pressure MPh2 in the refrigeration cycle of the main refrigerant circuit 20 can be controlled.

<Modification 3>

Although, in the embodiment above and Modifications 1 and 2, the structure in which the intermediate heat exchanger 26 that cools the main refrigerant is provided between the first main compressor 21 and the second main compressor 22 is used, it is not limited thereto. It is possible not to provide the intermediate heat exchanger 26.

<Modification 4>

Although, in the embodiment above and Modifications 1 to 3, the multi-stage compressor is constituted by the plurality of main compressors 21 and 22, it is not limited thereto. The multi-stage compressor may be constituted by one main compressor including the compression elements 21*a* and 21*b*. Alternatively, a single-stage compressor may be used for the main compressor.

<Modification 5>

Although the embodiment above and Modifications 1 to 4 are described by taking as an example a circuit configuration that performs a cooling operation, it is not limited thereto. A circuit configuration that is capable of performing a cooling operation and a heating operation may be used.

Although the embodiment of the present disclosure is described above, it is to be understood that various changes can be made in the forms and details without departing from the spirit and the scope of the present disclosure described in the claims.

INDUSTRIAL APPLICABILITY

The present disclosure is widely applicable to a refrigeration cycle device in which an expansion mechanism that causes power to be produced by decompressing a refrigerant is provided at a refrigerant circuit.

REFERENCE SIGNS LIST

1 refrigeration cycle device
9 control unit
20 main refrigerant circuit
21, 22 main compressor
21*a* low-stage-side compression element
22*a* high-stage-side compression element
25 main heat-source-side heat exchanger
27 main expansion mechanism
51 gas-liquid separator
52 degassing pipe
53 degassing expansion mechanism (main intermediate-pressure adjusting valve)
71*a*, 71*b* main use-side expansion mechanism (main intermediate-pressure adjusting valve)
72*a*, 72*b* main use-side heat exchanger
80 sub-refrigerant circuit
81 sub-compressor
83 sub-heat-source-side heat exchanger
85 sub-use-side heat exchanger

CITATION LIST

Patent Literature

Patent Literature 1
Japanese Unexamined Patent Application Publication No. 2013-139938

The invention claimed is:

1. A refrigeration cycle device comprising:
a main refrigerant circuit having
a main compressor that compresses a main refrigerant,
a main heat-source-side heat exchanger that functions as a radiator of the main refrigerant,
a main use-side heat exchanger that functions as an evaporator of the main refrigerant,
a main expansion mechanism including an expansion element of a rotary or scroll type that causes power to be produced by decompressing the main refrigerant that flows between the main heat-source-side heat exchanger and the main use-side heat exchanger, and
a main intermediate-pressure adjusting valve between the main expansion mechanism and the main use-side heat exchanger,
wherein the main refrigerant circuit has a sub-use-side heat exchanger that functions as a cooler of the main refrigerant that flows between the main expansion mechanism and the main use-side heat exchanger;
the refrigeration cycle device further comprising:
a sub-refrigerant circuit having
a sub-compressor that compresses a sub-refrigerant,
a sub-heat-source-side heat exchanger that functions as a radiator of the sub-refrigerant, and
the sub-use-side heat exchanger that functions as an evaporator of the sub-refrigerant and that cools the main refrigerant that flows between the main expansion mechanism and the main use-side heat exchanger; and
the refrigerant cycle device further comprising
a controller that controls the main intermediate-pressure adjusting valve in accordance with an input power of the sub-refrigerant circuit.

2. The refrigerant cycle device according to claim 1, wherein the controller obtains the input power of the sub-refrigerant circuit from outside air temperature or a current value of the sub-compressor.

3. The refrigeration cycle device according to claim 1, wherein the main intermediate-pressure adjusting valve is provided at a portion of the main refrigerant circuit, the portion being between the sub-use-side heat exchanger and the main use-side heat exchanger, and
wherein, when the input power of the sub-refrigerant circuit increases, the controller decreases an opening degree of the main intermediate-pressure adjusting valve.

4. The refrigerant cycle device according to claim 3, wherein, when the input power of the sub-refrigerant circuit decreases, the controller unit increases the opening degree of the main intermediate-pressure adjusting valve.

5. The refrigeration cycle device according to claim 1, wherein the main refrigerant circuit has a gas-liquid separator between the main expansion mechanism and the main use-side heat exchanger, the gas-liquid separator causing the main refrigerant decompressed at the main expansion mechanism to separate gas and liquid,
wherein a degassing pipe that extracts the main refrigerant in a gas state and sends the main refrigerant in the gas state toward a suction side of the main compressor is connected to the gas-liquid separator,
wherein the main intermediate-pressure adjusting valve is provided at the degassing pipe, and
wherein, when the input power of the sub-refrigerant circuit increases, the controller decreases an opening degree of the main intermediate-pressure adjusting valve.

6. The refrigerant cycle device according to claim 5, wherein, when the input power of the sub-refrigerant circuit decreases, the controller increases the opening degree of the main intermediate-pressure adjusting valve.

7. The refrigeration cycle device according to claim 1, wherein the main compressor includes a low-stage-side compression element of a rotary or scroll type that compresses the main refrigerant and a high-stage-side compression element of a rotary or scroll type that compresses the main refrigerant discharged from the low-stage-side compression element.

8. The refrigeration cycle device according to claim 1, wherein the main refrigerant is carbon dioxide, and
wherein the sub-refrigerant is a HFC refrigerant, a HFO refrigerant, or a mixture refrigerant in which the HFC refrigerant and the HFO refrigerant are mixed, each of the HFC refrigerant, the HFO refrigerant, and the mixture refrigerant having a GWP that is 750 or less.

9. The refrigeration cycle device according to claim 1, wherein the main refrigerant is carbon dioxide, and
wherein the sub-refrigerant circuit utilizes a natural refrigerant such that the sub-refrigerant circuit has a coefficient of performance that is higher than the coefficient of performance of the main refrigerant circuit using a carbon dioxide refrigerant.

10. The refrigeration cycle device according to claim 2, wherein the main intermediate-pressure adjusting valve is provided at a portion of the main refrigerant circuit, the portion being between the sub-use-side heat exchanger and the main use-side heat exchanger, and wherein, when the input power of the sub-refrigerant circuit increases, the controller decreases an opening degree of the main intermediate-pressure adjusting valve.

11. The refrigerant cycle device according to claim 10, wherein, when the input power of the sub-refrigerant circuit decreases, the control unit increases the opening degree of the main intermediate-pressure adjusting valve.

12. The refrigeration cycle device according to claim 2, wherein the main refrigerant circuit has a gas-liquid separator between the main expansion mechanism and the main use-side heat exchanger, the gas-liquid separator causing the main refrigerant decompressed at the main expansion mechanism to separate gas and liquid, wherein a degassing pipe that extracts the main refrigerant in a gas state and sends the main refrigerant in the gas state toward a suction side of the main compressor is connected to the gas-liquid separator, wherein the main intermediate-pressure adjusting valve is provided at the degassing pipe, and wherein, when the input power of the sub-refrigerant circuit increases, the controller decreases an opening degree of the main intermediate-pressure adjusting valve.

13. The refrigerant cycle device according to claim 12, wherein, when the input power of the sub-refrigerant circuit decreases, the controller increases the opening degree of the main intermediate-pressure adjusting valve.

14. The refrigeration cycle device according to claim 2, wherein the main compressor includes a low-stage-side compression element of a rotary or scroll type that compresses the main refrigerant and a high-stage-side compression element of a rotary or scroll type that compresses the main refrigerant discharged from the low-stage-side compression element.

15. The refrigeration cycle device according to claim 3, wherein the main compressor includes a low-stage-side compression element of a rotary or scroll type that compresses the main refrigerant and a high-stage-side compression element of a rotary or scroll type that compresses the main refrigerant discharged from the low-stage-side compression element.

16. The refrigeration cycle device according to claim 4, wherein the main compressor includes a low-stage-side compression element of a rotary or scroll type that compresses the main refrigerant and a high-stage-side compression element of a rotary or scroll type that compresses the main refrigerant discharged from the low-stage-side compression element.

17. The refrigeration cycle device according to claim 5, wherein the main compressor includes a low-stage-side compression element of a rotary or scroll type that compresses the main refrigerant and a high-stage-side compression element of a rotary or scroll type that compresses the main refrigerant discharged from the low-stage-side compression element.

18. A refrigeration cycle device comprising:

a main refrigerant circuit having a main compressor that compresses a main refrigerant, a main heat-source-side heat exchanger that functions as a radiator of the main refrigerant, a main use-side heat exchanger that functions as an evaporator of the main refrigerant, a main expansion mechanism including an expansion element of a rotary or scroll type that causes power to be produced by decompressing the main refrigerant that flows between the main heat-source-side heat exchanger and the main use-side heat exchanger, and a main intermediate-pressure adjusting valve between the main expansion mechanism and the main use-side heat exchanger, wherein the main refrigerant circuit has a sub-use-side heat exchanger that functions as a cooler of the main refrigerant that flows between the main expansion mechanism and the main use-side heat exchanger;

the refrigeration cycle device further comprising:

a sub-refrigerant circuit having a sub-compressor that compresses a sub-refrigerant, a sub-heat-source-side heat exchanger that functions as a radiator of the sub-refrigerant, and the sub-use-side heat exchanger that functions as an evaporator of the sub-refrigerant and that cools the main refrigerant that flows between the main expansion mechanism and the main use-side heat exchanger; and the refrigeration cycle device further comprising:

a controller that controls the main intermediate-pressure adjusting valve, wherein the controller controls an opening degree of the main intermediate-pressure adjusting valve inversely to the outside air temperature such that as the outside air temperature rises, the main intermediate-pressure adjusting valve is further closed, and as the outside air temperature falls, the main intermediate-pressure adjusting valve is further opened.

19. The refrigeration cycle device according to claim 18, wherein the main compressor includes a low-stage-side compression element of a rotary or scroll type that compresses the main refrigerant and a high-stage-side compression element of a rotary or scroll type that compresses the main refrigerant discharged from the low-stage-side compression element.

* * * * *